US011298289B2

(12) United States Patent
Horowitz

(10) Patent No.: US 11,298,289 B2
(45) Date of Patent: Apr. 12, 2022

(54) HANDHELD ROLLER

(71) Applicant: Ari Horowitz, New York, NY (US)

(72) Inventor: Ari Horowitz, New York, NY (US)

( * ) Notice: Subject to any disclaimer, the term of this patent is extended or adjusted under 35 U.S.C. 154(b) by 492 days.

(21) Appl. No.: 16/053,787

(22) Filed: Aug. 2, 2018

(65) Prior Publication Data

US 2019/0038499 A1 Feb. 7, 2019

Related U.S. Application Data

(60) Provisional application No. 62/540,540, filed on Aug. 2, 2017.

(51) Int. Cl.

| | |
|---|---|
| ***A61H 7/00*** | (2006.01) |
| ***A61H 15/00*** | (2006.01) |
| ***A63B 23/16*** | (2006.01) |
| ***A63H 33/00*** | (2006.01) |

(52) U.S. Cl.

CPC ..... *A61H 7/003* (2013.01); *A61H 15/00* (2013.01); *A61H 15/0092* (2013.01); *A63H 33/00* (2013.01); *A61H 2015/0014* (2013.01); *A61H 2201/0153* (2013.01); *A61H 2201/02* (2013.01); *A61H 2201/1253* (2013.01); *A61H 2201/169* (2013.01); *A61H 2201/1635* (2013.01); *A61H 2201/1671* (2013.01); *A61H 2205/065* (2013.01); *A61H 2205/12* (2013.01); *A63B 23/16* (2013.01)

(58) Field of Classification Search

CPC .. A61H 7/003; A61H 15/00; A61H 2015/007; A61H 2015/0021; A61H 2015/0028; A61H 2015/0035; A61H 2015/0042; A61H 2015/005; A61H 2015/0057; A61H 2015/0071; A61H 15/0078; A61H 15/0092; A61H 15/02; A61H 2201/0153; A61H 2201/1253; A61H 2201/1635; A61H 2201/1671; A61H 2201/169; A61H 2205/065; A63H 33/00; A63H 23/16

USPC ..... D24/211–215

See application file for complete search history.

(56) References Cited

U.S. PATENT DOCUMENTS

| | | | | | |
|---|---|---|---|---|---|
| 1,071,998 | A * | 9/1913 | Gibbs | A61H 15/0092 | 601/119 |
| 1,969,042 | A * | 8/1934 | Senn | A61H 15/0092 | 601/19 |
| 2,273,710 | A * | 2/1942 | Klaes | | 601/119 |
| 2,578,916 | A * | 12/1951 | Belleville | A61H 15/00 | 601/125 |

(Continued)

FOREIGN PATENT DOCUMENTS

| | | | | |
|---|---|---|---|---|
| FR | 2667502 A1 * | 4/1992 | | A63B 22/0605 |
| GB | 393557 A * | 6/1933 | | A61H 15/0092 |

OTHER PUBLICATIONS

English translation for FR-2667502A1, espacenet.com, translated on Apr. 28, 2021.*

*Primary Examiner* — Tu A Vo

(74) *Attorney, Agent, or Firm* — Lainie E. Parker

(57) ABSTRACT

The present invention is a handheld roller having at least two units that can spin around while the handheld roller is flipped or rotated to occupy, entertain and soothe the user. The handheld roller can also be applied to other parts of the body, including the other hand; placed on the floor or other surface and body part rolled against it.

17 Claims, 8 Drawing Sheets

(56) References Cited

U.S. PATENT DOCUMENTS 3,779,548 A * 12/1973 Sato ..... A63B 23/16 482/44
3,970,078 A * 7/1976 Rogers, Jr. ..... A61H 15/0092 601/125
4,193,394 A 3/1980 Everett
4,417,727 A * 11/1983 Ottenheimer ..... A63B 21/0023 482/44
4,964,630 A 10/1990 Curtiss
4,989,585 A * 2/1991 Auker ..... A61H 15/0092 601/118
5,218,955 A * 6/1993 Gueret ..... A61H 15/0092 601/123
5,580,335 A 12/1996 Smith, IV
D385,319 S 10/1997 Lucas
6,090,055 A 7/2000 Frajdenrajch
6,306,109 B1 * 10/2001 Polychronis ..... A61H 15/0092 601/128
6,419,650 B1 7/2002 Ryan
6,974,427 B1 * 12/2005 Lapham ..... A61H 15/00 601/120
8,684,883 B2 4/2014 Sappenfield
8,959,720 B2 2/2015 Szu
9,810,260 B2 11/2017 Naonari
D855,127 S 7/2019 Lucas
2002/0055427 A1 * 5/2002 Jennings ..... A63B 23/16 482/148
2005/0049532 A1 * 3/2005 Lee ..... A61H 15/00 601/118
2005/0131320 A1 * 6/2005 Lee ..... A61H 15/0092 601/119
2006/0235343 A1 * 10/2006 Fitzmaurice ..... A61H 15/0092 601/131
2010/0274165 A1 * 10/2010 Evans ..... A61H 15/00 601/122
2011/0021959 A1 * 1/2011 Brown ..... A61H 15/00 601/122
2012/0310125 A1 12/2012 Wendell
2013/0012848 A1 * 1/2013 Forrest ..... A61H 15/02 601/19
2013/0123078 A1 5/2013 Marji
2015/0133271 A1 * 5/2015 Jones ..... A61H 15/00 482/51
2017/0056284 A1 3/2017 Kramer

* cited by examiner

FIG. 2
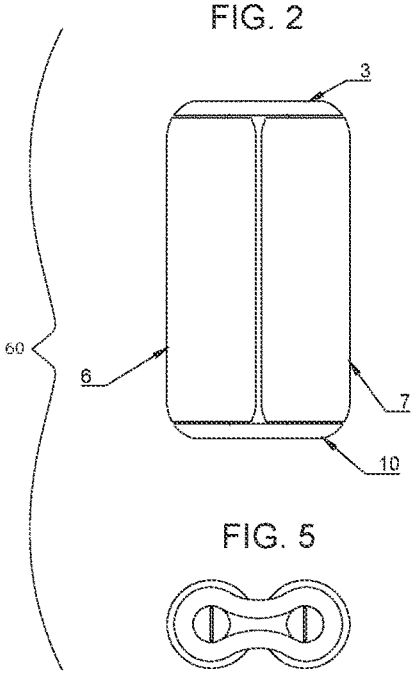
FIG. 3
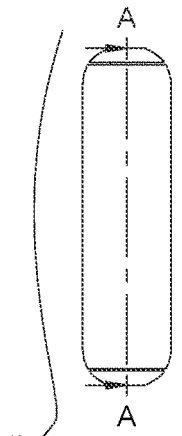
FIG. 4
A-A (1:1)
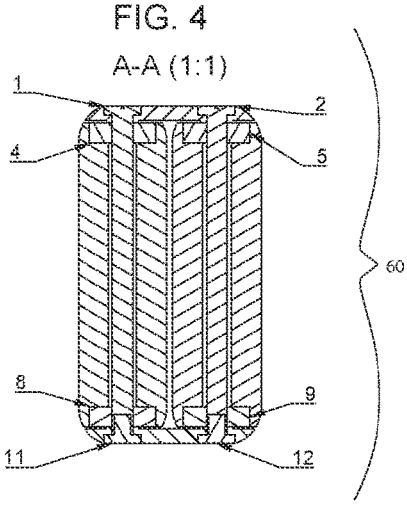
FIG. 5
FIG.6
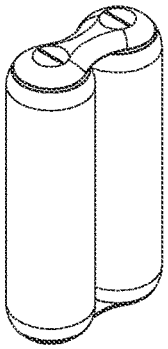

FIG. 11
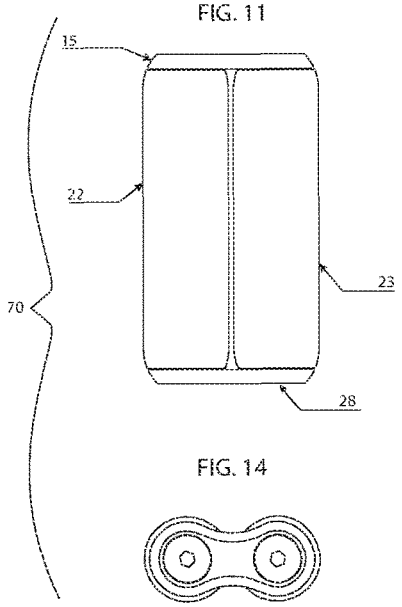
FIG. 12
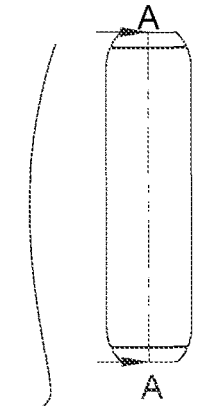
FIG. 13
A-A
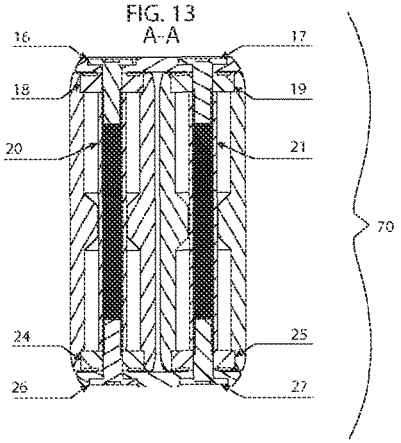
FIG. 14
FIG. 15
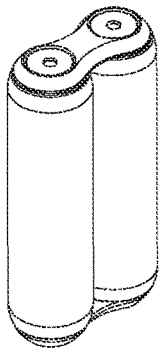

HANDHELD ROLLER

CROSS-REFERENCE TO RELATED APPLICATIONS

This patent application claims the benefit of, and priority to U.S. Provisional Patent Application No. 62/540,540, filed on Aug. 2, 2017 and such provisional patent application is incorporated herein in its entirety by this reference.

FIELD OF THE INVENTION

The present invention relates to fidget devices. More particularly, the present invention relates to a handheld device comprising one or more rollers which can occupy a user by rolling the device within one or both hands, and it can also be rolled upon a surface, thereby occupying the user's attention and/or calming the user.

BACKGROUND OF THE INVENTION

Currently, there are a number of fidget devices. Most recently many kids, and some adults, have enjoyed what is commonly known as a fidget spinner. People have long kept worry stones in their pockets. Such stones can be found on the ground and some are manufactured, smoothed down and sold for just that purpose. Cigarettes, gum and food have also been devices employed by those who fidget.

Unfortunately, fidget spinners tend to be noisy and attractive when used, making others, besides the user, lose their concentration. Further, with respect to worry stones, it's not generally acceptable to be seen fiddling around in one's pocket. Finally, it can be unhealthy to indulge in cigarettes, gum and/or food every time a person feels fidgety.

The present invention provides solutions to these problems. It is virtually quiet, mostly hidden when held within a hand and operates to exercise hand, finger, wrist and arm muscles and burn calories while in use, making it a healthy alternative as well.

SUMMARY OF THE INVENTION

The present invention is a handheld roller and method of using the same, the roller comprising:

at least two units (and/or rollers), each of the units having an axis about which the unit spins, each unit having a first end and a second end;

a first point of connection being at the first end of each unit;

a second point of connection being at the second end of each unit;

a first arm, the first arm being connected to the first point of connection at the first end of each of the at least two units, in one embodiment, the first arm covers the first ends of each of the units thereby;

a second arm, the second arm being connected to the second point of connection at the second end of each of the at least two units, in one embodiment, the second arm covers the second ends of each of the units thereby; and the first arm and the second arm together as a combination, when connected to the first points and second points, respectively, at the ends of each of the at least two units, forming a structural frame for holding and supporting the at least two units in place, but allowing for each of the units (and/or rollers) to spin independently of each other and independently of the structural frame.

In one embodiment of the handheld roller described above, the axis of each unit is parallel with the axis of every other unit. In one embodiment of the handheld roller described above, the units are parallel to each other. In one embodiment of the handheld roller described above, the units are perpendicular to the arms. In one embodiment of the handheld roller described above, the arms are parallel to each other.

In one embodiment of the handheld roller described above, the axis of one unit is at an oblique angle with the axis of at least one other unit. In one embodiment of the handheld roller described above, one unit is at an oblique angle to at least one other unit. In one embodiment of the handheld roller described above, the arms are bent at an angle to accommodate the angle of the units and still be able to attach to points at their respective ends.

Further, the present invention is a hand held roller and method of using the same, the roller comprising:

at least two sets of units, each of the sets having at least two sub-units, and each of the sets having an axis about which the sets of units spin, each set having at least one section between its sub-units;

at least one attachment point at each section between the sub-units of each set of units;

one or more attaching devices, the one or more attaching devices connecting to the at least one attachment point at each section between the sub-units of each set of units; and the one or more attaching devices, when connecting the at least two units, forming a structural frame with the attachment points for holding and supporting the at least two sets of units in place, but allowing for the at least two sets of units to spin independently of each other and independently of the frame.

The one or more sub units can spin in the same direction of the other units in its same set or independently (and, thus, in a different direction) of the other units in its same set. Additionally, when each set, in the same handheld roller, includes one or more sub units, the sub units in different sets can spin in the same direction of the sub units of the other sets, or they can spin independently (and, thus, in a different direction) of the of the sub units of the other sets.

Still further, the present invention is a hand held roller and method of using the same, the roller comprising:

at least two cylindrical units, (and in one of the embodiments the cylindrical units being parallel with the other,)

each cylindrical unit having a first end and a second end;

a first point of connection being at the first end of each unit;

a second point of connection being at the second end of each unit;

a first arm, the first arm being connected to the first point at the first end of each of the at least two cylindrical units;

a second arm, the second arm being connected to the second point at the second end of each of the at least two cylindrical units; and the first arm and the second arm together as a combination, when connected to the first and second points, respectively, at the ends of each of the at least two cylindrical units, forming a structural frame for holding and supporting the at least two cylindrical units in place, but allowing for each of the cylindrical units (and/or rollers) to spin independently of each other and independently of the structural frame.

The invention also contemplates several methods of using the handheld roller. In one method, the user holds the device in the hand by the units (or rollers) and then continues to flip or rotate the device, roller over roller, while spinning the individual units (or rollers), using the hand, finger and/or other muscles, for as long as desired. In another method, the user holds the handheld roller in both hands, in a praying hand formation, and uses both hands to rotate the device, roller over roller, while spinning the individual units (or rollers). In another method, the user simply spins the individual rollers. These methods are useful for reducing anxiety and stress, cleansing hands, entertaining, and exercising, as described below.

The handheld roller of the present invention is a wonderful anxiety reducing and stress relieving device as well as an entertaining toy and it can be used as a handheld massager.

The primary objective of the invention is to relieve stress and produce a calming effect for fidgety and easily distracted individuals.

Another objective of the invention is to help people stop engaging in harmful oral fixations such as smoking cigarettes by providing a continuous handheld activity.

Still another objective is to cleanse the user's hands of microbes by producing the invention out of an antibacterial, antifungal, and/or antimicrobial material or a material treated with an antibacterial, antifungal, and/or antimicrobial substance.

Another objective is to use the invention as a toy to occupy, entertain or distract the user.

Another objective is to enhance physical fitness by building muscles, such as, but not limited to, hand, wrist, finger, and forearm muscles.

Although preferred embodiments of the present invention are described, it will be understood by those skilled in the art that the present invention should not be limited to the described embodiments. Rather, various changes and modifications can be made within the spirit and scope of the present invention.

Further, although specific advantages have been enumerated above and herein, various embodiments may include some, none, or all of the enumerated advantages.

Definitions

The definitions herein supplement and further define publicly available definitions. If the definitions herein differ from publicly available definitions, then the definitions herein apply when interpreting the scope of the invention, specification, claims and abstract. Additionally, definitions of terms herein are not limited to those in this section headed "DEFINITIONS", since terms and phrases are also defined elsewhere in the specification, claims and abstract.

An "arm" is generally defined as a device for attaching the units together and it can also be referred to herein as a cover, an attaching device, attachment device and/or a device for attaching. The term "arm" as used herein is also used interchangeably with "cap", since the cap also attaches the units together and covers the end of the units. The arm can also cover the end of the units.

An "axis" is generally defined as an imaginary line about which a body rotates. In the present invention, the axis of a unit defines the space around which the unit spins.

A "ball bearing" is generally defined as a bearing with spheres or solid material. It allows the unit to spin without unscrewing the screw, if present.

A "bearing is generally defined as a device used to bear weight and buffer between, load-bearing, two other devices.

A "bore" is a hole, usually a cylindrical hole.

A "cap" is generally defined as a device for attaching the units together and it can also be referred to herein as a cover, an attaching device, attachment device and/or a device for attaching. The term "cap" as used herein is also used interchangeably with "arm", since the arm also attaches the units together and covers the end of the units. The cap can also cover the end of the units.

A "free-hand shape" is generally defined as a shape that is created and shaped from time to time by the inventor or others; the shape can be made by hand, for example from clay, putty or other material of that type, or it can be designed on a computer or app and printed out on a 3-D printer, etc.

Something that is Handheld, Hand-held or hand held is designed and sized to be held by the hand, Hand-sized or hand sized; it has a size that fits in a user's hand.

A "unit" or "sub-unit" is generally defined as at least one of the two or more objects making up the hand-held roller of the present invention and such term is herein used interchangeably with other terms descriptive of at least one of such objects of the present invention, including, but not limited to, a cylinder, circle or sphere, oval or ovoid, square or cube, rectangle or rectangular prism, triangle or triangular prism, column, barrel, tube, casing, housing, roller, etc., also a free-hand shape, which is created and shaped from time to time by the inventor or others, is also envisioned. Each unit or set of units is sized so that it can be held in the hand(s) of a user and manipulated by the hand(s) of a user. Thus, each unit can be longer than a user's hand and still be capable of being held therein and manipulated thereby. However, there's more of a limit as to how wide each unit can be and still be capable of being held in the hand of a user and manipulated thereby. That said, it is anticipated that different sized units will be manufactured for different sized hands.

BRIEF DESCRIPTION OF THE DRAWINGS

FIG. 2 depicts a front view of the first embodiment of the handheld roller.

FIG. 3 depicts a side view of the first embodiment of the handheld roller.

FIG. 4 depicts a cross-sectional view of the first embodiment of the handheld roller which is taken along line A-A of FIG. 3.

FIG. 5 depicts a top plan view of the first embodiment of the handheld roller.

FIG. 6 depicts a perspective view of the first embodiment of the handheld roller.

FIG. 11 depicts a front view of a second embodiment of the handheld roller.

FIG. 12 depicts a side view of the second embodiment of the handheld roller.

FIG. 13 depicts a cross-sectional view of the second embodiment of the handheld roller which is taken along line A-A of FIG. 12.

FIG. 14 depicts a top plan view of the second embodiment of the handheld roller.

FIG. 15 depicts a perspective view of the second embodiment of the handheld roller.

DETAILED DESCRIPTION OF THE INVENTION

Figure 1:
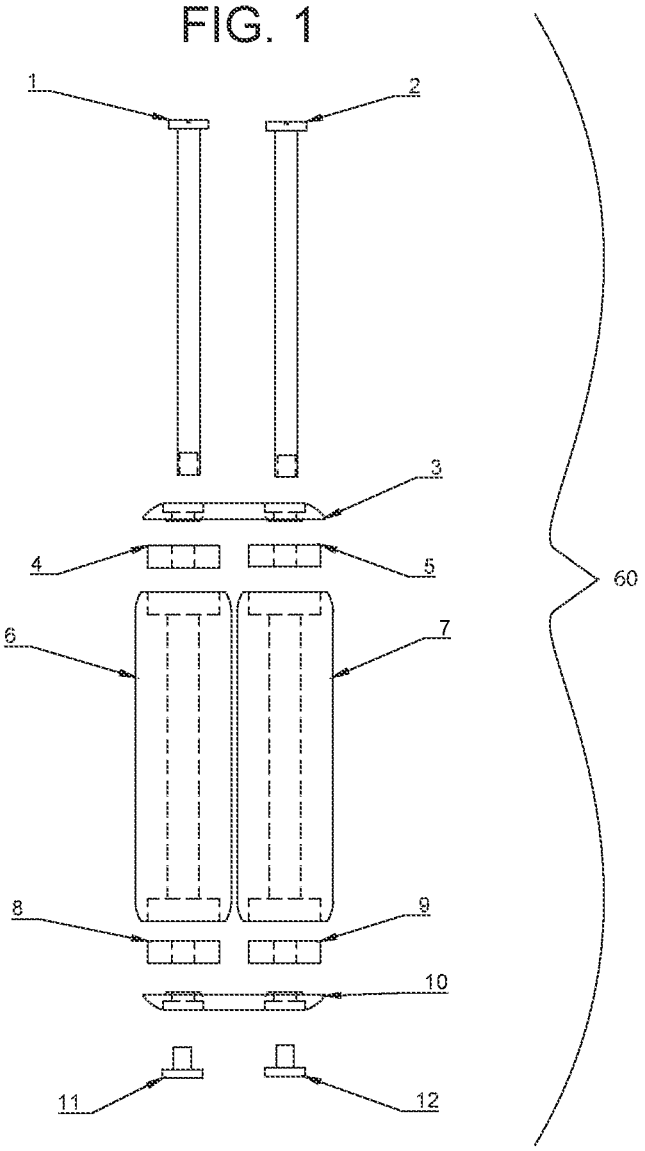
FIG. 1 depicts an exploded front sectional view showing the parts of a first embodiment of the handheld roller.
Figure 7:
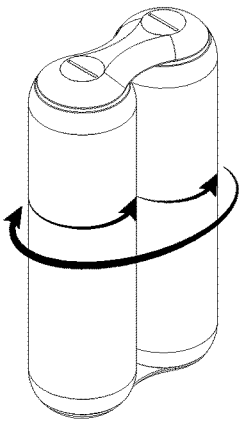
FIG. 7 depicts a perspective view of the first embodiment of the handheld roller and indicates the direction of spin of each roller compared with the rotational direction of the handheld roller during one method of use.

The present invention is a hand held roller and method of using the same, the roller comprising:

at least two units, each of the units having an axis about which the unit spins, the shape of the units is a matter of choice, possible shapes include, but are not limited to cylindrical, spherical, oval, cubic, rectangular, triangular, etc., also a free-hand shape, which is created and shaped from time to time by the inventor or others, is also envisioned, also, the units can be rollers, barrels, tubes, casings and/or housings, the units can be solid, hollow and/or partly solid and partly hollow, the units and/or sub-units in each hand held roller do not need to be the same type and/or shape, it is advantageous if the outside shape of the units are formed so that they can each spin freely without knocking into or getting caught on one another, and it is advantageous that the connection between the units and the arms/caps permits for free spinning as well, (and in one of the embodiments the axis of each unit being parallel with the axis of every other unit), each unit having a first end and a second end;

a first point of connection being at the first end of each unit;

a second point of connection being at the second end of each unit;

a first arm, the first arm being connected to the first point at the first end of each of the at least two units;

a second arm, the second arm being connected to the second point at the second end of each of the at least two units;

in one embodiment, the cap/arm is a solid piece with space for attachments (for example, spaces to attach to the point of connection) or the cap/arm has attaching devices built in (for example, a device that attaches to the point of connection); and the first arm and the second arm together as a combination, when connected to the first and second points, respectively, at the ends of each of the at least two units, forming a structural frame for holding and supporting the at least two units in place, but allowing for each of the units (and/or rollers) to spin independently of each other and independently of the structural frame.

Further the present invention is a hand held roller comprising:

at least two cylindrical units, the cylindrical units being parallel with each other, each cylindrical unit having a first end and a second end;

a first arm, the first arm being connected to the first end of each of the at least two cylindrical units;

a second arm, the second arm being connected to the second end of each of the at least two cylindrical units; and the first arm and the second arm together as a combination, when connected to the first and second end of each of the at least two cylindrical units, respectively, holding and supporting the at least two cylindrical units in place.

Further the present invention is a hand held roller comprising:

at least two spherical units, the spherical units being parallel with each other, each spherical unit having a first end and a second end;

a first arm, the first arm being connected to the first end of each of the at least two spherical units;

a second arm, the second arm being connected to the second end of each of the at least two spherical units; and the first arm and the second arm together as a combination, when connected to the first and second end of each of the at least two spherical units, respectively, holding and supporting the at least two spherical units in place.

Further the present invention is a hand held roller comprising:

at least two ovoid units, the ovoid units being parallel with each other, each ovoid unit having a first end and a second end;

a first arm, the first arm being connected to the first end of each of the at least two ovoid units;

a second arm, the second arm being connected to the second end of each of the at least two ovoid units; and the first arm and the second arm together as a combination, when connected to the first and second end of each of the at least two ovoid units, respectively, holding and supporting the at least two ovoid units in place.

Further the present invention is a hand held roller comprising:

at least two rectangular units, the rectangular units being parallel with each other, each rectangular unit having a first end and a second end;

a first arm, the first arm being connected to the first end of each of the at least two rectangular units;

a second arm, the second arm being connected to the second end of each of the at least two rectangular units; and the first arm and the second arm together as a combination, when connected to the first and second end of each of the at least two rectangular units, respectively, holding and supporting the at least two rectangular units in place.

Further the present invention is a hand held roller comprising:

at least two free-hand shaped units, the free-hand shaped units being parallel with each other, each free-hand shaped unit having a first end and a second end;

a first arm, the first arm being connected to the first end of each of the at least two free-hand shaped units;

a second arm, the second arm being connected to the second end of each of the at least two free-hand shaped units; and the first arm and the second arm together as a combination, when connected to the first and second end of each of the at least two free-hand shaped units, respectively, holding and supporting the at least two free-hand shaped units in place.

A first handheld roller comprising:

at least two units, each of the units having an axis about which each unit spins, each unit having a first end and a second end;

a first point of connection being at the first end of each unit;

a second point of connection being at the second end of each unit;

a first cover, the first cover being connected to the first points of connection at the first ends of each of the at least two units;

a second cover, the second cover being connected to the second points of connection at the second ends of each of the at least two units; and a structural frame of the combination of the first cover and the second cover together with their connections to the first points and second points, respectively, at the ends of each of the at least two units, for holding and supporting the at least two units in place, but allowing for each of the units to spin independently of each other and independently of the structural frame.

The first handheld roller, wherein the axis of each unit is parallel with the axis of every other unit.

The first handheld roller, wherein a. at least one unit is a barrel, tube, housing, casing, sphere, ovoid, cube, rectangular prism, triangular prism, or free-hand shape;

b. at least one unit has a diameter or width of about 0.1 to about 1.55 inches, about 0.15 to about 0.95 inch, or about 0.7 to about 1 inch;

c. at least one unit is wood, plastic, metal, copper, brass, titanium, and/or steel, a material that is antibacterial, antifungal, and/or antimicrobial, and/or a material treated to have antimicrobial properties, and/or a combination of these materials;

d. at least one unit has a surface texture that is smooth, bumpy, wavy, nubby, and/or has ridges; and e. at least one unit has a cover layer of rubber, silicone, and/or fabric.

The first handheld roller, wherein the first cover and the second cover have the same size and shape;

at least one of the first cover and the second cover is the same material as at least one of the units; and at least one of the first cover and the second cover is solid.

The first handheld roller, wherein the first points of connection are short screws, long screws, medium screws, nails, pins, nuts, bolts, or tacks, the first points of connection are inserted through the first cover and connected to the second points of connection;

the second points of connection are short screws, long screws, medium screws, nails, pins, nuts, bolts, or tacks, and the second points of connection are inserted through the second cover and connected to the first points of connection.

The handheld roller above, further comprising at least one ring, at least one of the first points of connection and/or the second points of connection are inserted through the at least one ring after having been inserted through the first cover or the second cover.

The handheld roller above, wherein the at least one ring is a ball bearing.

The first handheld roller, wherein at least one unit has a bore through its axis, the bore containing the points of connection, the bore is not substantially wider than the points of connection, and the remainder of the unit is substantially solid.

The first handheld roller, wherein at least one unit has a bore through its axis, the bore containing the points of connection, at least one portion of the bore is substantially wider than the points of connection, and at least one portion of the bore is not substantially wider than the points of connection.

A second embodiment of the first handheld roller, wherein the axis of one unit is at an oblique angle with the axis of at least one other unit.

The second embodiment of the first handheld roller, wherein a. at least one unit is a barrel, tube, housing, casing, sphere, ovoid, cube, rectangular prism, triangular prism, or free-hand shape;

b. at least one unit has a diameter or width of about 0.1 to about 1.55, about 0.15 to about 0.95, or about 0.7 to about 1 inch;

c. at least one unit is wood, plastic, metal, copper, brass, titanium, and/or steel, a material that is antibacterial, antifungal, and/or antimicrobial, and/or a material treated to have antimicrobial properties, and/or a combination of these materials;

d. at least one unit has a surface texture that is smooth, bumpy, wavy, nubby, and/or has ridges; and e. at least one unit has a cover layer of rubber, silicone, and/or fabric.

The second embodiment of the first handheld roller, wherein the first cover and the second cover have the same size and shape;

at least one of the first cover and the second cover is the same material as at least one of the units; and at least one of the first cover and the second cover is solid.

The second embodiment of the first handheld roller, wherein the first points of connection are short screws, long screws, medium screws, nails, pins, nuts, bolts, or tacks, the first points of connection are inserted through the first cover and connected to the second points of connection;

the second points of connection are short screws, long screws, medium screws, nails, pins, nuts, bolts, or tacks, and the second points of connection are inserted through the second cover and connected to the first points of connection.

The handheld roller above, further comprising at least one ring, at least one of the first points of connection and/or the second points of connection are inserted through the at least one ring after having been inserted through the first cover of the second cover.

The handheld roller above, wherein the at least one ring is a ball bearing.

The second embodiment of the first handheld roller, wherein at least one unit has a bore through its axis, the bore containing the points of connection, the bore is not substantially wider than the points of connection, and the remainder of the unit is solid.

The second embodiment of the first handheld roller, wherein at least one unit has a bore through its axis, the bore containing the points of connection, at least one portion of the bore is substantially wider than the points of connection, and at least one portion of the bore is not substantially wider than the points of connection.

A third embodiment of a handheld roller comprising:

at least two sets of units, each of the sets having at least two sub-units, and each of the sets having an axis about which the sets of units spin, each set having at least one section between its sub-units;

at least one attachment point at each section between the sub-units of each set of units;

one or more attaching devices, the one or more attaching devices connecting to the at least one attachment point at each section between the sub-units of each set of units; and the one or more attaching devices, when connecting the at least two sets of units, forming a structural frame with the attachment points for holding and supporting the at least two sets of units in place, but allowing for the at least two sets of units, and one or more of the sub-units, to spin independently of each other and independently of the frame.

The third embodiment of the handheld roller, wherein a. at least one sub-unit is a barrel, tube, housing, casing, sphere, ovoid, cube, rectangular prism, triangular prism, or free-hand shape;
b. at least one sub-unit has a diameter or width of about 0.1 to about 1.55, about 0.15 to about 0.95, or about 0.7 to about 1 inch;
c. at least one sub-unit is wood, plastic, metal, copper, brass, titanium, and/or steel, a material that is antibacterial, antifungal, and/or antimicrobial, and/or a material treated to have antimicrobial properties, and/or a combination of these materials;
d. at least one sub-unit has a surface texture that is smooth, bumpy, wavy, nubby, and/or has ridges; and
e. at least one sub-unit has a cover layer of rubber, silicone, and/or fabric.

The third embodiment of the handheld roller, wherein the attachment points are short screws, long screws, medium screws, nails, pins, nuts, bolts, or tacks;

the attaching device is the same material as one of the sub-units;

at least one sub-unit has a bore through its axis, the bore contains the attachment points and is not substantially wider than the attachment points, and the remainder of the sub-unit is solid; and at least one other sub-unit has a bore through its axis, the bore contains the attachment points, at least one portion of the bore is substantially wider than the attachment points, and at least one portion of the bore is not substantially wider than the attachment points.

FIG. 1 depicts a first embodiment of a handheld roller 60. In FIG. 1, long screws 1 and 2 run most of the length of handheld roller 60 and are each considered a point of connection herein.

Connecting arm or cap 3 is used to position cylinders (also called "units" herein) 6 and 7 a specific distance apart from each other. Connecting arm 3 rotates with cylinders 6 and 7 as cylinders 6 and 7 rotate around each other when the device is manipulated by the user. However, connecting arm 3 rotates in a direction opposite to the direction that cylinders 6 and 7 spin as cylinders 6 and 7 rotate around each other when the device is manipulated by the user.

Rings 4 and 5 are also each considered a point of connection herein. They fit into the top of cylinders 6 and 7 and come between the connecting arm 3 and cylinders 6 and 7. Rings 4 and 5 rotate with cylinders 6 and 7 as they rotate around each other when the device is manipulated by the user. Rings 8 and 9 are also each considered a point of connection herein. They fit the bottom of cylinders 6 and 7 and are adjacent to connecting arm/cap 10. Both connecting arms/caps 3 and 10 in this embodiment and in the other embodiments are adjacent to the rings and units, and in some cases cover the rings and units, like a cap.

The rings can be special bearings of the type which permit the cylinders to spin in one direction, while not allowing the screws to spin. One example is a ball bearing. Other bearings are mentioned elsewhere in the specification, or are known in the art, or might later become known or invented, and are considered within the scope of the present invention.

These bearings help prevent the structural framework of the inventive handheld roller from un-screwing and, thus, falling apart while it is in use.

Short male screws 11 and 12, each considered a point of connection herein, are inserted or screwed into connecting arm/cap 10 and into the ends of long female screws 1 and 2. It is also within the scope of the invention for the short screws to be female screws and the long screws to be male screws, or for one unit to have a short female screw and a long male screw while one or two other units have short male screws and long female screws, and/or any combination of these.

During manufacture, the long screws 1 and 2 run most of the length of handheld roller 60 and are used to connect the rest of the sections to each other. Long screw 1 is inserted through arm 3, ring 4, and cylinder 6 to attach to short screw 11, which goes through arm 10 and ring 8, to connect all of the sections for cylinder 6.

Long screw 2 is inserted through arm 3, ring 5, and cylinder 7, to attach to short screw 12, which goes through arm 10 and ring 8, to connect all of the sections for cylinder 7.

The arms 3 and 10 then connect the cylinder units (two cylinder units have been shown and described, but more units and other shapes are certainly within the scope of the present invention) to hold the handheld roller 60 together and provide the support it needs to maintain its frame or structure. The screws and arms together form a structural frame that supports and holds the handheld roller of the invention, so that no additional support bar is needed. This is unlike some published patent applications which have an I-frame including a support bar in-between the rolling elements in order to provide additional support to maintain its frame or structure. In the present invention, the frame formed by the screws (or other points of contact) and arms/caps (or other attaching devices) is a solid, support structure that remains strong and solid while the units (or rollers) independently spin.

Usually, both arms 3 and 10 are about the same size and have the positions for the insertion of the long screws match up with the positions for the short screws so that both ends of cylinders 6 and 7 are aligned in a parallel fashion. Additionally, this results in the cylinders 6 and 7 being maintained at a static distance apart. The distance between the cylinders is generally less than about 1 inch, and can be less than about ¾ inch, and can be less than about ½ inch, and can be less than about ¼ inch, and can be less than about ⅛ inch and can be less than about 1/16 inch. Even though this discussion refers to two cylinders as shown in the figures, the scope of the invention encompasses more than two cylinders, and/or units having other shapes as well. So any time two cylinders are discussed, it is also applicable to configurations with more than two cylinders and/or with units having other shapes.

Rings 4, 5, 8 and 9 can sit on top of, or adjacent to, or fit into the ends of their respective cylinders as shown in FIG. 1. The rings can be weight-bearing, like a bearing to buffer the space between the arms and the cylinders.

There are many different types of bearings and they should all work with the present invention. Some examples of bearings that should work in the present invention include, but are not limited to plain bearings, rolling element bearings (which also include ball bearings and roller bearings), jewel bearings, fluid bearings, magnetic bearings, flexure bearings, etc.

In one embodiment of the invention, a ball bearing is used and the outer collar of the bearing spins together with the unit (or roller), whereas the inner collar of the bearing would spin with the screw, or other connection device.

The short male screws screw into the long female screws, as shown, for example, in FIGS. 1 and 14. However, the shorts screws can just as easily be female screws and the long screws can be male screws. Also, the invention can use long female or male screws and short male or female screws. The gender named connectors can be switched around, it is not necessary for them to be the same, it is not necessary to use the same ones in every hand-held roller of the invention or in every unit of every handheld roller, so long as the parts can be connected.

FIGS. 11-17 depict a second embodiment of the present invention. In FIG. 11, handheld roller 70 has cylindrically shaped spinning units 22 and 23, each having a first end and a second end. Arm (or cap) 15 attaches units 22 and 23 together at either their first ends or their second ends, while arm (or cap) 28 attaches units 22 and 23 together at their other ends.

FIG. 13 shows a cross-sectional view of handheld roller 70 taken along line A-A of FIG. 12. In FIG. 13 and sectional view FIG. 16, handheld roller 70 has short screws 30, 29, each considered a point of connection herein, which fit through their respective spaces 32 and 31 (each considered a point of connection herein) of arm 15, through their respective rings 34 and 33 (each considered a point of connection herein) and into spaces 20, 21 (each considered a point of connection herein) in the cylinders 22, 23 to sit in spaces 16 and 17 (each considered a point of connection herein) of arm 15. The respective heads of short screws 30, 29 sit in spaces 16 and 17 (each considered a point of connection herein) of arm 15.

Rings 34 and 33 sit, respectively, in spaces 18 and 19 (each considered a point of connection herein) of the cylinders 22, 23. Long screws 37, 38 (each considered a point of connection herein) fit through spaces 20, 21 in the cylinders 22, 23 (the long screws can also be threaded through those spaces).

The short screws 30, 29 (each considered a point of connection herein) go through rings 34 and 33 (each considered a point of connection herein), respectively, and are threaded into long screws 37, 38, respectively, to attach one arm 15 of the handheld roller to one end of each of the units 22 and 23.

In this example, short screws 30, 29 are male and are threaded into the long screws 37, 38, respectively, which are female. However, other alternatives are possible as well. For example, the short screws can be female and the long screws can be male, the short screw of one unit could be male with a long female screw while the short screw of the other unit is female with a long male screw, etc. The key is that the cylinders get connected. So, it is possible to use other attaching devices instead of short and long screws. Another alternative is to use pins at the ends of each unit which can be attached to each other. Yet another alternative is to connect the units by bisecting them with one or more connecting devices going through each of them, or even by one connecting device at or near the center of one or more of the units.

Figure 16:
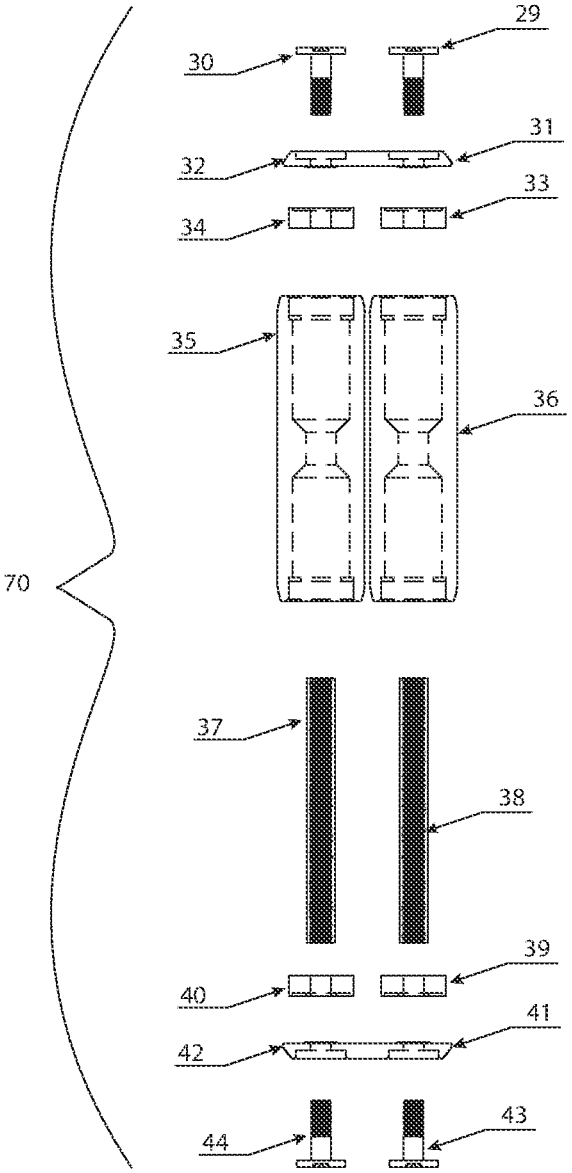
FIG. 16 depicts an exploded front sectional view showing the parts of the second embodiment of the handheld roller.

Then, FIGS. 13 and 16 repeat the structure of the short screws, arm and rings on the other end of the cylinders. There, short screws 44, 43 (each considered a point of connection herein), which fit through their respective spaces 42 and 41 (each considered a point of connection herein) of arm 28, through their respective rings 40 and 39 (each considered a point of connection herein) and into spaces 20, 21 in the cylinders 22, 23 to sit in spaces 16 and 17 (each considered a point of connection herein) of arm 15. The respective heads of short screws 30, 29 (each considered a point of connection herein) sit in spaces 26 and 27 (each considered a point of connection herein) of arm 28.

Rings 40 and 39 (each considered a point of connection herein) sit, respectively, in spaces 24 and 25 (each considered a point of connection herein) of the cylinders 22, 23. Long screws 37, 38 fit through spaces 20, 21 in the cylinders 22, 23 (the long screws can also be threaded through those spaces).

The short screws 44, 43 (each considered a point of connection herein) go through rings 40 and 39 (each considered a point of connection herein), respectively, and are threaded into long screws 37, 38, respectively, to attach the other arm 28 of the handheld roller to the other end of each of the units 22 and 23.

In this example, short screws 44, 43 are male and are threaded into the long screws 37, 38, respectively, which are female. However, other alternatives are possible as well. For example, the short screws can be female and the long screws can be male, the short screw of one unit could be male with a long female screw while the short screw of the other unit is female with a long male screw, etc. The key is that the cylinders get connected. So, it is possible to use other attaching devices instead of short and long screws. Another alternative is to use pins at the ends of each unit, to attach the unit to the arm, so the units can be attached to each other. Yet another alternative is to connect the units by bisecting them with one or more connecting devices going through each of them, or even by one connecting device at or near the center of one or more of the units.

Figure 17:
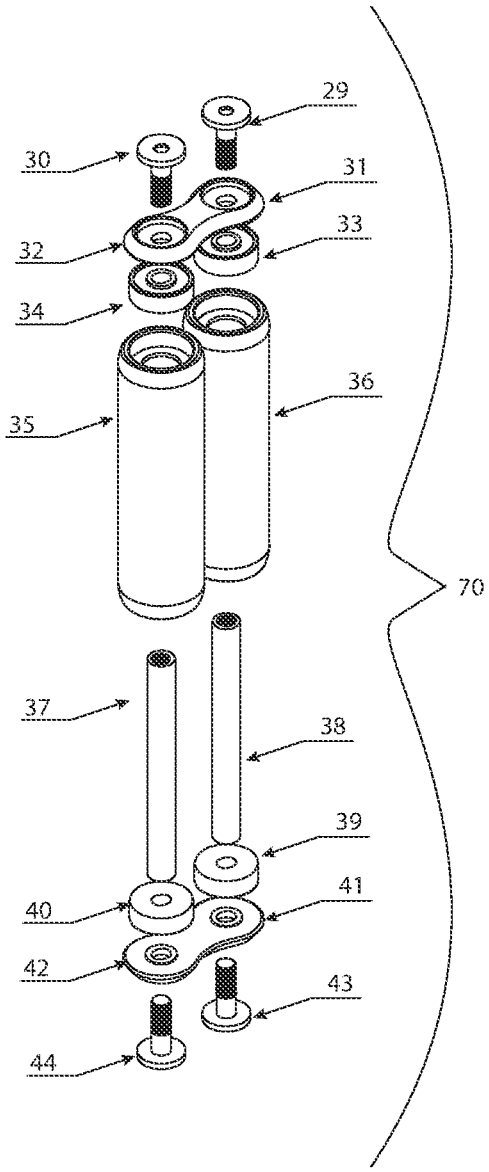
FIG. 17 depicts an exploded perspective view showing the parts of the second embodiment of the handheld roller.

FIG. 17 is an exploded perspective view and bearing 39 is a specific type of ball bearing which has a hollow center with a double ring structure encasing spheres, as shown in the figure. Bearing 40 is an example of another specific type of ball bearing which has a hollow center with a double ring structure encasing a solid, rubbery substance, as shown in the figure. For example, bearing 40 can be a bearing with packing, meaning it has thick grease for lubrication. The grease is in the gaps between the bearing surfaces and it is held in place by a plastic, leather, or rubber gasket that covers the inside and outside edges of the bearing race.

In FIG. 17, as in FIG. 16., handheld roller 70 has short screws 30, 29 (each considered a point of connection herein), which fit through arm 15, their respective rings 34 and 33 (each considered a point of connection herein) and into cylinders 22, 23. Long screws 37, 38 (each considered a point of connection herein) also go into cylinders 22, 23.

The short screws 44, 43 (each considered a point of connection herein) go through arm 28, rings 40 and 39 (each considered a point of connection herein), respectively, and are threaded into long screws 37, 38, respectively, to attach the other arm 28 of the handheld roller to the other end of each of the units 22 and 23.

The screws and arms together form a structural frame that supports the handheld roller of the invention, so that no additional support bar is needed. This is unlike some patent applications which have an I-frame including a support bar in-between the rolling elements in order to provide additional support to maintain its frame or structure.

One difference that can be seen between the two embodiments shown in the drawings is illustrated in FIGS. 4 and 13. The cylindrically shaped rollers in FIG. 4 are much more solid, with only a central bore along its axis. In contrast, the cylindrically shaped rollers in FIG. 13 are much less solid, more hollow, and only have extra solid material at point 36 as shown in FIG. 16. This decrease in solid material lowers both the shipping weight and production cost of the handheld roller. It is advantageous that the present invention is small and portable, as well as light in weight.

Additionally, even though the second embodiment depicted in FIGS. 11-17 has a different appearance and different hardware, it still operates the same as the first embodiment, meaning it has the same motions as shown by the arrows in FIGS. 7-10. Indeed, although the outward appearance and inner and/or outer hardware can be changed, yet still be covered by and within the scope of the presently claimed invention, it is the intent that the motions in FIGS. 7-10 remain substantially the same.

Figure 18:
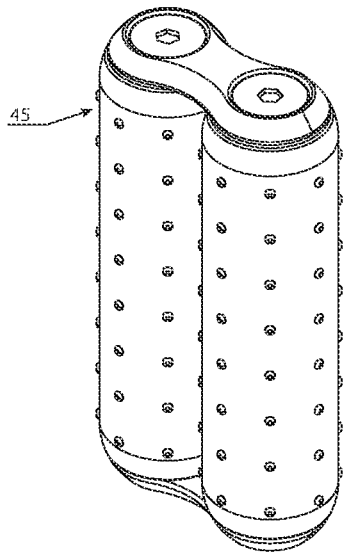
FIG. 18 depicts a perspective view of the handheld roller of the invention with a nubby surface.

FIG. 18 depicts a perspective view of the handheld roller of the invention with a nubby or bumpy surface, including a plurality of individual nubs 45. The nubs 45 are shown in a specific pattern in FIG. 18, but it is within the scope of the invention for the nubs 45 to be placed in any other pattern or to be placed in no pattern at all. Additionally, nubs 45 can be made bigger or smaller than those shown in FIG. 18. When nubs 45 are bigger, they are more likely to be referred to as bumps.

The material and/or covering of the spinning units in FIG. 18 can be of any type or combination which produces these nubs 45. Examples of such material and/or covering include, but are not limited to rubber, silicone, fabric, wood, plastic, glass, metal, copper, brass, titanium, steel, a material that is antibacterial, antifungal, and/or antimicrobial, including, but not limited to, copper, partly copper, elements of copper, silver, partly silver, a material that is treated to have antibacterial, antifungal, and/or antimicrobial properties, and/or a combination of any or all of these materials, etc.

Figure 19:
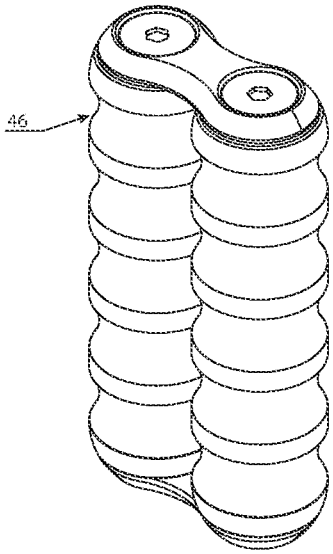
FIG. 19 depicts a perspective view of the handheld roller of the invention with a wavy surface.

FIG. 19 depicts a perspective view of the handheld roller of the invention with a surface that can be described as wavy or as having ridges 46. The ridges 46 are shown in a specific pattern in FIG. 19, but it is within the scope of the invention for ridges 46 to be placed in any other pattern or to be placed in no pattern at all. Additionally, ridges 46 can be made bigger or smaller than those shown in FIG. 19. When ridges 46 are on a diagonal and/or made with wavy lines, they are more likely to be referred to as waves.

The material and/or covering of the spinning units in FIG. 19 can be of any type or combination which produces these ridges 46. Examples of such material and/or covering include, but are not limited to rubber, silicone, fabric, wood, plastic, glass, metal, copper, brass, titanium, steel, a material that is antibacterial, antifungal, and/or antimicrobial, including, but not limited to, copper, partly copper, elements of copper, silver, partly silver, a material that is treated to have antibacterial, antifungal, and/or antimicrobial properties, and/or a combination of any or all of these materials, etc.

Figure 20:
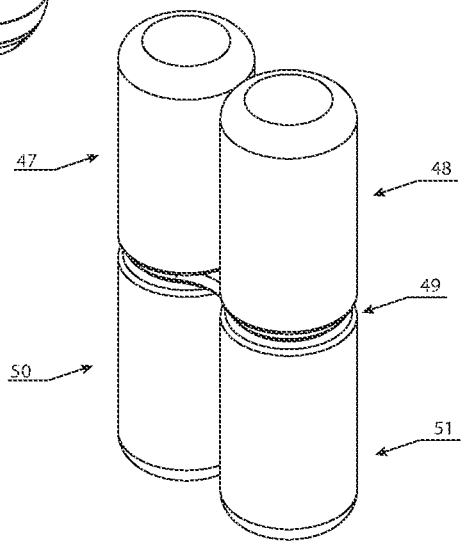
FIG. 20 depicts a perspective view of a third embodiment of the handheld roller.

A third embodiment of the invention is depicted in FIG. 20. It shows a set of units with sub-units 47, 50 and another set of units with sub-units 48, 51 which come together to form two sets of units. Arm 49 is an attaching device and it connects the two sets of units in a manner that would bisect their mid-sections, if each unit set were a single piece as in the other figures.

As it is though, each set of units has at least one attachment point at each section between its sub-units, where arm 49 is connected. In one embodiment, the arm 49 is the same type of arm/cap having ends 32, 31 as in FIG. 17. In that embodiment, the attachment point is usually something that runs most of the length of the set of units or is attached to something(s) so that its length is extended to run most of the length of the set of units, such as, but not limited to, the points of connection described herein, screws, pins, bolts, and/or dowels, etc.

Then, the one or more attaching devices, here arm 49, when connecting the at least two sets of units, forms a structural frame with the points of connection for holding and supporting the at least two sets of units in place, but allowing for the at least two sets of units to spin independently of each other and independently of the frame. Additionally, each of the sub-units in each set of units can spin independently of each other as well.

Figure 21:
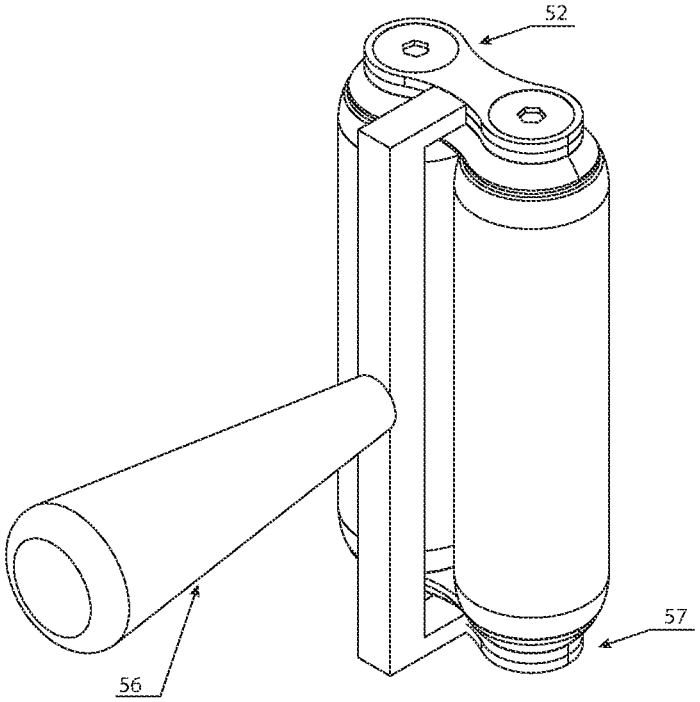
FIG. 21 depicts a perspective view of the handheld roller with a handle.

An alternative embodiment is shown in FIG. 21 where a handle has been added to the handheld roller. This handle has a gripping area 56 and two arms 52 and 57. In this embodiment, the screws or other types of points of connection are removed and the arms 52, 57 of the handle are placed over the arms of the handheld roller. Then, the screws or other types of points of connection are inserted and/or screwed through the arms 52, 57 to attach the handle. Also, this is just an example of a handle and the scope of the invention should not be limited to this particular embodiment, since a handle only requires a part that a user can grip and something to connect that grip to the handheld roller.

Further, the handle can be made of any material, such as, but not limited to rubber, silicone, wood, plastic, glass, metal, copper, brass, titanium, steel, a material that is antibacterial, antifungal, and/or antimicrobial, including, but not limited to, copper, partly copper, elements of copper, silver, partly silver, a material that is treated to have antibacterial, antifungal, and/or antimicrobial properties, and/or a combination of any or all of these materials, etc.

Figure 22:
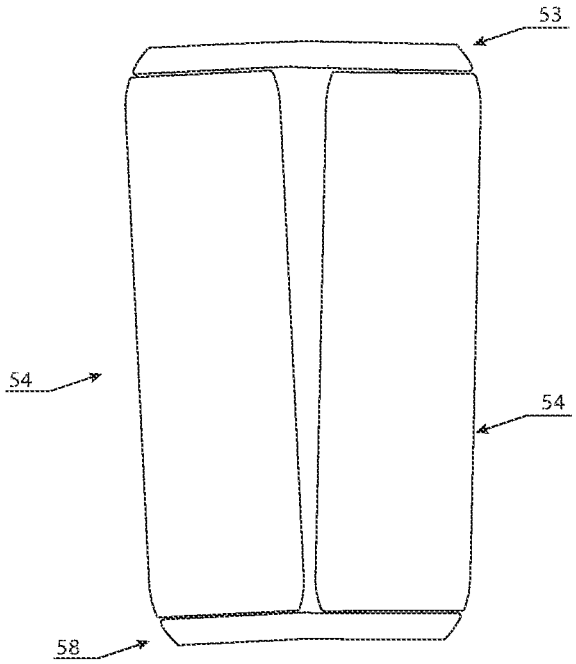
FIG. 22 depicts a front view of a fourth embodiment of the handheld roller.

FIG. 22 shows a fourth embodiment of the present invention in which the axis of rollers 54 and 55, and, thus, rollers 54 and 55 are at an oblique angle to one another. In this embodiment, the arms/caps 53 and 58 are bent at an angle and arm/cap 53 is longer than arm/cap 58 to accommodate the oblique angle of the units to one another and still be able to attach to points at the respective ends of these units. This embodiment might better fit some hands, since the hand is narrower at one end when closing the hand to flip or rotate the handheld roller of the invention.

Figure 23:
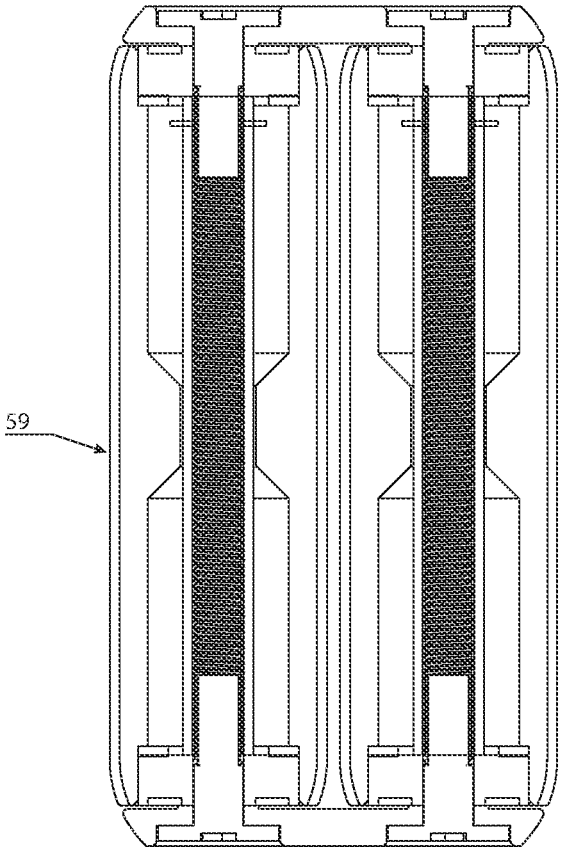
FIG. 23 depicts a sectional view of the handheld roller of the present invention.

The sectional view of the handheld roller in FIG. 23 shows the handheld roller of the invention with a thin layer of silicone (a cover or cover material herein), for example approximately 1/16 of an inch, about 2 mm, etc. The silicone adds some comfort and tactile tackiness and softness to further enhance the enjoyment of the handheld roller by the user. When the silicone layer is added, it is also possible to decrease the diameter or width of the unit by the thickness of the added layer. So here, the diameter or width of the unit would be decreased by about 1/16 of an inch, about 2 mm, etc.

Figure 8:
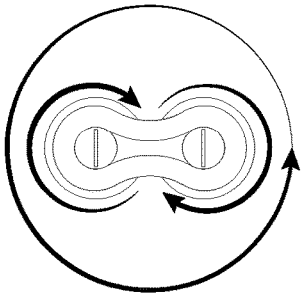
FIG. 8 depicts a top plan view of the first embodiment of the handheld roller and indicates the direction of spin of each roller compared with the rotational direction of the handheld roller during one method of use.
Figure 9:
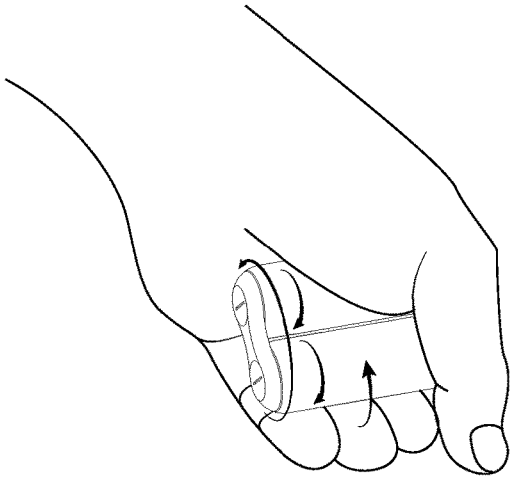
FIG. 9 depicts the hand of a user demonstrating a step in one method of using the first embodiment of the handheld roller and indicates the direction of spin of each unit/roller compared with the rotational direction of the handheld roller. When describing the movements of the invention, the motion of each unit/roller is generally described as spinning while the motion of the entire handheld roller, as it is being flipped over and over in the hand, is generally described as rotating.
Figure 10:
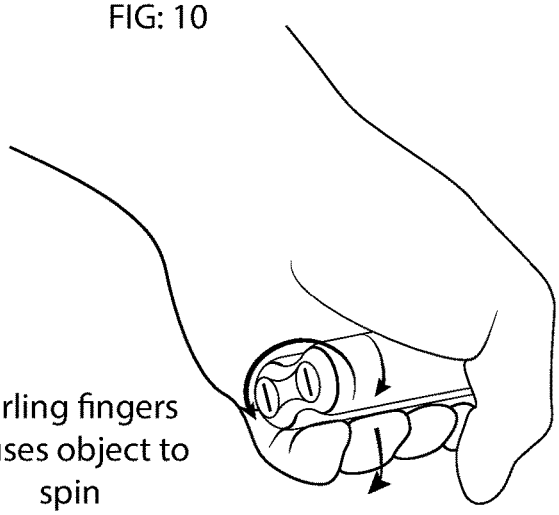
FIG. 10 depicts the hand of a user demonstrating a method step either preceding or following the method step depicted in FIG. 9 of one method of using the first embodiment of the handheld roller and indicates the direction of spin of each unit/roller compared with the rotational direction of the handheld roller. When describing the movements of the invention, the motion of each unit/roller is generally described as spinning while the motion of the entire handheld roller, as it is being flipped over and over in the hand, is generally described as rotating.

Further details of the present invention include, but are not limited to:

In relation to the units:

amount—at least two, two or more, in some embodiments, the units are also referred to as spinning units, shape—barrels, tubes, units, housings, casings, spherical, oval, cubic, rectangular, triangular, etc., a free-hand shape, which is created and shaped from time to time by the inventor or others, is also envisioned, and the scope of the invention covers such free-hand shapes already known in the art, or might later become known and/or created, and are considered within the scope of the present invention, size—length pre-determined to fit a user's hand and range of sizes, diameter (this term is also used to refer to width if the unit is not a sphere or cylinder) about 0.1, 0.2, 0.3, 0.4, 0.5, 0.6, 0.7, 0.8, 0.9, 1, 1.1, 1.2, 1.3, 1.5 inches, diameter about 0.15, 0.25, 0.35, 0.45, 0.55, 0.65, 0.75, 0.85, 0.95, 1.05, 1.15, 1.25, 1.35, 1.55 inches, and diameter ranges anywhere in between these diameters, such as, but not limited to, about 0.1 to about 1.55, about 0.15 to about 0.95, about 0.7 to about 1 inch, etc., length about 1, 2, 3, 4 inches, length about 1.5, 2.5, 3.5, 4.5 inches, and length ranges anywhere in between these lengths, such as, but not limited to, about 1 to about 3.5, about 2 to about 4, about 2.5 to about 3 inches, etc.

the units can be substantially the same size when the handheld roller has at least two units, or three or more units, and when there are three or more units, the units are usually smaller in diameter so that they can still fit in a user's hand, but all the units do not have to be the same size material—wood, plastic, glass, metal, copper, brass, titanium, steel, a material that is antibacterial, antifungal, and/or antimicrobial, including, but not limited to, copper, partly copper, elements of copper, silver, partly silver, and/or treated to have antimicrobial properties, a combination of any or all of these materials etc., rubber, silicone, fabric, wood, plastic, glass, metal, copper, brass, titanium, steel, a material that is antibacterial, antifungal, and/or antimicrobial, including, but not limited to, copper, partly copper, elements of copper, silver, partly silver, a material that is treated to have antibacterial, antifungal, and/or antimicrobial properties, and/or a combination of any or all of these materials, etc.

some of these materials, especially the metal ones, are conductive and can be heated or cooled to impart a warm or cool feeling when used, cover material/layer—add a rubber, silicone, fabric, etc. cover, possibly decrease diameter of unit by thickness of cover added surface texture—smooth, bumpy, wavy, nubby, and/or ridges in any combination, etc.

hollow/solid/mixed—the units can be hollow, solid or partly hollow and partly solid (mixed), or some units can be hollow, some can be solid and some can be mixed; a solid unit usually has a bore partially or completely through its axis where its screws, nuts and bolts, nails, pins, tacks, other points of connection, etc. are located, the bore includes at least a de minimis amount of space surrounding the point of connection so that the point of connection is easily slid into the bore (in other words, the bore is not substantially wider than the points of connection), but there is not so much space since the point of connection is held within the bore of the unit (so the point of connection, e.g., the screw, doesn't shift around too much) and the remainder of the unit is solid, so the unit would be substantially solid except for the bore hole; a hollow unit would have a lot more empty space around the point of connection (so the point of connection, e.g., screw would shift around a lot more than in the "solid" unit), but a partly solid (mixed) unit would fill in some of that empty space around the point of connection with solid material where the bore would be more narrow around the point of connection, but still include at least a de minimis amount of space surrounding the point of connection so that the point of connection is easily slid into the bore, as shown in FIGS. 13 and 16; a mixed unit, like a hollow unit would still be substantially hollow, but the mixed unit would have a solid section where a portion of the bore is filled in so that the bore is more narrow or closed around the point of connection (in other words, at least one portion of the bore is substantially wider than the points of connection, and at least one portion of the bore is not substantially wider than the points of connection), this closing around the point of connection should help maintain the structure of the frame formed from the covers and the points of connection; so generally, the bore is as long and as wide as needed for the points of connection, and in some embodiments the bore and/or portions of the bore is adjusted to help hold the points of connection (e.g., a screw, bolt, pin, etc.) in place In relation to the attachment devices: cap, end cap, arm, cover, covering, Material rubber, silicone, fabric, wood, plastic, glass, metal, copper, brass, titanium, steel, a material that is antibacterial, antifungal, and/or antimicrobial, including, but not limited to, copper, partly copper, elements of copper, silver, partly silver, a material that is treated to have antibacterial, antifungal, and/or antimicrobial properties, and/or a combination of any or all of these materials, etc., the material can be the same or different from the units, and the first and second attachment devices (arms/caps) can be the same or different materials attaching device, in one embodiment the attaching device is a solid piece with holes or attachment sites for connecting with points of connection, as opposed to the attaching device being hollow, like a tube, the arm/cap can also have the points of connection, screws, pins, etc. pre-attached or they can be molded together, attachment sites for as many units as are present, or more the length of the attachment devices should be sufficient to separate the cylindrical units from each other a static fixed amount sufficient to permit the units free rotation around their individual axes, and in one embodiment so that the units do not come into contact with one another, they remain separated a static amount, distance between attachment sites are spaced such that the units are separated about 1 inch or less, about ¾ inch or less, about ½ inch or less, about ¼ inch or less, about ⅛ inch or less, about 1/16 of an inch, the range of distance between the units ends up being between about 1/16 and about ¼ inch or less, about ⅛ and about ½ inch or less, about 1/16 and about 1 inch or less, about ⅛ and about ¾ inch or less, etc.

shape—suitable to connect ends of units, such as the spinning units, such as, but not limited to oval, rectangular, figure-8, hourglass, etc., a shape where each end mimics the shape around the end of each unit at the point of connection, as shown, for example, in FIGS. 5, 6, 7, 14 and 15, in the case where the unit (or spinning unit) is cylindrical, and then, if any other units are present, the shape of the arm at the point(s) of connection to the other unit(s) can mimic the end of their shapes as well at the point(s) of connection, or can be any other shape, and, in the case where only two units are present, the arm can maintain the shape of the ends of the arm in the space that spans across the two units to create an oval shape, or it can extend outwardly to make some un-named free-hand shape, or some other well-known or named shape, or it the arm can pinch in as shown in FIGS. 5, 6, 7, 14 and 15, to create a figure-8 shape, in some embodiments, each arm is the same size and shape as the others, or each arm differs from the others in size and/or shape, or some are the same with respect to size and/or shape and some are different with respect to size and/or shape Both arms/caps together, when attached to the ends of the units, form a frame structure to support the structure of the handheld roller, both arms together holding the at least two units adjacent to each other with a fixed space between them, the arms/caps can keep the cylinders fixed in place so that they remain in the same proximity to each other as they are rotated around one another, In relation to the attachment points: screws, nails, pins, tacks, nuts and bolts, etc., which can be inserted or threaded through the covers or arms/caps, or the attachment devices, or could be permanently attached or be extensions of the covers or arms/caps Screws with different heads, for example, but not limited to, flat, hex, slot, cross, phillips, hex, hex socket, etc.

Length—sufficient, depends on length of unit and height of ring and arm that it needs to clear, a long screw with no head can reach substantially all the way across the unit and attach to two short screws with heads (to sit on the cover/arm, if desired) at the first and second ends of the unit, as in FIG. 16, or the long screw can be even longer and have a head to sit on the cover, if desired, and then attach to a short screw with a head at the other end of the unit (and the head of the short screw can sit on the cover/arm, if desired), as in FIG. 1, or there can be two medium-sized screws, each having a head (which can sit on the cover, if desired), one entering the unit from the first end and one from the second end and then they are capable of being screwed together where they meet up In relation to the ring: there are many different types and widths of rings, some embodiments of this invention use bearings, examples of bearings that should work in the present invention include, but are not limited to plain bearings, rolling element bearings (which also include ball bearings and roller bearings), jewel bearings, fluid bearings, magnetic bearings, flexure bearings, etc.

In relation to the handle;

The handle can be attached anywhere to the handheld roller if desired, and can be attached to one or both of the arms or caps, it can be attached to, for example, the screw drive, the cavity and protrusions on the screw head, if screws are present, there are many different types of screw drives examples, flat, hex, slot, cross, phillips, hex, hex socket, etc.

Material The handle can be made of any material, such as, but not limited to rubber, silicone, wood, plastic, glass, metal, copper, brass, titanium, steel, a material that is antibacterial, antifungal, and/or antimicrobial, including, but not limited to, copper, partly copper, elements of copper, silver, partly silver, a material that is treated to have antibacterial, antifungal, and/or antimicrobial properties, and/or a combination of any or all of these materials, etc., the material can be the same or different from the units and/or the cover/cap/arm.

Although the invention is a fidget device, it also finds use as a massager. In one embodiment, the handheld roller is placed on the ground and rolled beneath a foot to massage the sole. In another embodiment, the handheld roller is rolled over the body for massage and this method can be aided by the handle shown in FIG. 21.

REFERENCE NUMBERS

1 long screw
2 long screw
3 arm (cap)
4 ring
5 ring
6 cylinder
7 cylinder
8 ring
9 ring
10 arm (cap)
11 short screw
12 short screw
15 arm (cap)
16 space in arm for short screw, or other attachment device
17 space in arm for short screw, or other attachment device
18 space in unit for ring
19 space in unit for ring
20 space in unit for long screw, or other attachment device
21 space in unit for long screw, or other attachment device
22 cylindrical-shaped spinning unit
23 cylindrical-shaped spinning unit
24 space in unit for ring
25 space in unit for ring
26 space in arm for short screw, or other attachment device
27 space in arm for short screw, or other attachment device
28 arm (cap)
29 short screw
30 short screw
31 arm space
32 arm space
33 ring
34 ring
35 solid wall of cylinder
36 solid section of cylinder
37 long screw
38 long screw
39 ring
40 ring
41 arm space
42 arm space
43 short screw
44 short screw
45 nub(s)
46 ridge(s)
47 sub-unit
48 sub-unit
49 arm (attaching device)
50 sub-unit
51 sub-unit
59 cover material
60 handheld roller
70 handheld roller Although the above description contains many specificities, these should not be construed as limiting the scope of the invention but as merely providing illustrations of some of the preferred embodiments of this invention.

Modifications, additions, or omissions may be made to the apparatuses, and methods described herein without departing from the scope of the disclosure. For example, the components of the apparatuses may be integrated or separated. Moreover, the operations of the apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicant notes that he does not intend any of the appended claims or claim elements to invoke 35 U.S.C. 112(f) unless the words "means for" or "step for" are explicitly used in the particular claim.

What is claimed is:

1. A handheld roller comprising:

at least two rollers, each of the at least two rollers having an axis about which each roller spins, each of the at least two rollers having a first end and a second end;

a first connector being at the first end of each of the at least two rollers;

a second connector being at the second end of each of the at least two rollers;

a first cover, the first cover being connected to the first connectors at the first end of each of the at least two rollers;

a second cover, the second cover being connected to the second connectors at the second end of each of the at least two rollers;

wherein an exposed surface of each of the first connectors is substantially flush with an exposed exterior surface of the first cover, an exposed surface of each of the second connectors is substantially flush with an exposed exterior surface of the second cover, the exposed surface of the first cover is free of protrusion, the exposed exterior surface of the second cover is free of protrusion, and there is no handle being attached to either the first cover and the second cover; and a structural frame of a combination of the first cover and the second cover together with the first connectors and the second connectors, respectively, at the first and second ends of each of the at least two rollers, for holding and supporting the at least two rollers in place, but allowing for each of the rollers to spin independently of each other and independently of the structural frame, wherein an entirety of the handheld roller is configured to fit in a palm of a user's hand, and wherein a space between the at least two rollers comprises a distance that is less than 1 inch.

2. The handheld roller of claim 1, wherein the axis of a first roller of the at least two rollers is parallel with the axis of a second roller of the at least two rollers.

3. The handheld roller of claim 1, wherein a) at least one roller of the at least two rollers comprises a barrel, tube, housing, casing, sphere, ovoid, cube, rectangular prism, triangular prism, or free-hand shape;

b) the at least one roller of the at least two rollers has a diameter or width of about 0.1 to about 1.55 inches, about 0.15 to about 0.95 inch, or about 0.7 to about 1 inch;

c) the at least one roller of the at least two rollers comprises wood, plastic, metal, copper, brass, titanium, steel, a material that is antibacterial, a material that is antifungal, a material that is antimicrobial, a material treated to have antimicrobial properties, and/or a combination of these materials;

d) the at least one roller of the at least two rollers has a surface texture that is smooth, bumpy, wavy, nubby, and/or has ridges; and e) the at least one roller of the at least two rollers has a cover layer of rubber, silicone, and/or fabric.

4. The handheld roller of claim 1, wherein the first cover and the second cover have the same size and shape;

at least one of the first cover and the second cover is the same material as at least one of the at least two rollers; and at least one of the first cover and the second cover is solid.

5. The handheld roller of claim 1, wherein the first connectors is at least one of the following connectors: short screws, long screws, medium screws, nails, pins, nuts, bolts, or tacks, which are inserted through the first cover;

the second connectors is at least one of the following connectors: short screws, long screws, medium screws, nails, pins, nuts, bolts, or tacks, which are inserted through the second cover, and the first connectors are connected to the second connectors.

6. The handheld roller of claim 5, further comprising at least first one ring and at least second one ring, wherein the at least first one ring is being positioned under the first cover, and/or the at least second one ring being positioned under the second cover.

7. The handheld roller of claim 6, wherein the at least one ring is a ball bearing.

8. The handheld roller of claim 1, wherein at least one roller of the at least two rollers has a bore along its axis, the bore containing one of the first connectors and one of the second connectors, the bore is not substantially wider than the one of the first connectors or the one of the second connectors.

9. The handheld roller of claim 1, wherein at least one roller of the at least two rollers has a bore along its axis, the bore containing one of the first connectors and one of the second connectors, wherein a first portion of the bore is wider than a second portion of the bore.

10. The handheld roller of claim 1, wherein the axis of one roller of the at least two rollers is at an oblique angle with the axis of at least one other roller of the at least two rollers.

11. The handheld roller of claim 10, wherein a) at least roller of the at least two rollers is a barrel, tube, housing, casing, sphere, ovoid, cube, rectangular prism, triangular prism, or free-hand shape;

b) at least one roller of the at least two rollers has a diameter or width of about 0.1 to about 1.55 inches, about 0.15 to about 0.95 inch, or about 0.7 to about 1 inch;

c) at least one roller of the at least two rollers comprises wood, plastic, metal, copper, brass, titanium, steel, a material that is antibacterial, a material that is antifungal, a material that is antimicrobial, a material treated to have antimicrobial properties, and/or a combination of these materials;

d) at least one roller of the at least two rollers has a surface texture that is smooth, bumpy, wavy, nubby, and/or has ridges; and e) at least one roller of the at least two rollers has a cover layer of rubber, silicone, and/or fabric.

12. The handheld roller of claim 10, wherein the first cover and the second cover have the same size and shape;

at least one of the first cover and the second cover is the same material as at least one of the at least two rollers; and at least one of the first cover and the second cover is solid.

13. The handheld roller of claim 10, wherein the first cover is connected to the first connectors, and the first connectors are at least one of the following connectors: short screws, long screws, medium screws, nails, pins, nuts, bolts, or tacks, which are inserted through the first cover;

the second cover is connected to the second connectors and the second connectors are at least one of the following connectors: short screws, long screws, medium screws, nails, pins, nuts, bolts, or tacks, which are inserted through the second cover, and the first connectors are connected to the second connectors.

14. The handheld roller of claim 13, further comprising at least first one ring and at least second one ring, wherein the at least first one ring is being positioned under the first cover, and/or the at least second one ring being positioned under the second cover.

15. The handheld roller of claim 14, wherein the at least one ring is a ball bearing.

16. The handheld roller of claim 10, wherein at least one roller of the at least two rollers has a bore along its axis, the bore containing one of the first connectors and one of the second connectors, the bore is not substantially wider than the one of the first connectors or the one of the second connectors.

17. The handheld roller of claim 10, wherein at least one roller of the at least two rollers has a bore along its axis, the bore containing one of the first connectors and one of the second connectors, wherein a first portion of the bore is wider than a second portion of the bore.

* * * * *